United States Patent [19]

Stevens

[11] 4,208,132

[45] Jun. 17, 1980

[54] ANTISTATIC METHOD AND APPARATUS

[75] Inventor: Barbara E. Stevens, Mission Viejo, Calif.

[73] Assignee: Baxter Travenol Laboratories, Inc., Deerfield, Ill.

[21] Appl. No.: 927,782

[22] Filed: Jul. 25, 1978

[51] Int. Cl.[2] ..... B01F 13/02; B01F 13/06

[52] U.S. Cl. ..... 366/101; 361/213

[58] Field of Search ..... 366/101, 107, 139; 361/212, 213, 215, 230; 422/44, 45; 260/112 R, 112 B

[56] References Cited

U.S. PATENT DOCUMENTS

| | | |
|---|---|---|
| 696,222 | 3/1902 | Arledter . |
| 2,314,940 | 3/1943 | Hewitt . |
| 2,477,269 | 7/1949 | Sandler . |
| 2,877,159 | 3/1959 | Lachman . |
| 2,896,263 | 7/1959 | Frederick . |
| 3,228,838 | 1/1966 | Rinfret ..... 435/260 |
| 3,864,602 | 2/1975 | Feder . |

*Primary Examiner*—Robert W. Jenkins

*Attorney, Agent, or Firm*—Paul C. Flattery; Lawrence W. Flynn; Max D. Hensley

[57] ABSTRACT

Static charge accretion as a result of particle handling is prevented or reduced by contacting the particles with an ionized noble gas. Particularly beneficial results are obtained by contacting dried, particulate animal body fluid with an ionized gas while conducting sieving, blending or dispensing operations.

Apparatus for contacting the ionized gas with particles so as to control static charge accumulation employs a flowthrough ionized gas, preferrably a noble gas, in which ionization takes place outside of the apparatus particle treatment region.

28 Claims, 1 Drawing Figure

ANTISTATIC METHOD AND APPARATUS

BACKGROUND OF THE INVENTION

This invention relates to processes and apparatus for handling masses of particulate matter. The efficient operation of such processes and apparatus has been hampered by the accumulation of static charge by the particles, particularly under conditions of low humidity. The accumulation of static charges is a function of the contact of the particles against one another and various components of the apparatus used to perform processes such as sieving, blending or dispensing of the particulate matter. Static charge accretion is disadvantageous because it causes the particles to aggregate into masses or to adhere to the surfaces of the particle processing apparatus. For the purposes herein a treatment region is defined as the area within a particle handling apparatus in which static charge will ordinarily be acquired by the particles due to their motion relative to one another on the apparatus. An example of a treatment region is a blending chamber. A treatment process is a process for handling particles during which static charge will ordinarily be acquired by the particles by their motion in a treatment region.

Applicant has observed this problem to be particularly acute when processing particles of dried animal body fluid such as human or bovine blood serum. The particles may be produced either by bulk lyophilization of sera, followed by low temperature comminution of the dried cake, or by spraying a stream of serum into a moving bath of refrigerant maintained at a temperature below the freezing point of the serum, followed by recovery and lyophilization of the frozen serum particles. The latter method has been preferred because it yields particles having more uniform geometry and mass, and it entails less loss of heat labile constituents such as enzymes.

Such serum products have numerous uses. However, one especially valuable use is in the manufacture of controls and calibrators. Since the serum is dry, large numbers of production lots may be combined into a single, large bulk lot from which quantities of dried sera may be metered into portions convenient for use in the clinical laboratory. The assembly of bulk lots has made it possible to obtain serum constituent uniformity over a much larger mass of product than has heretofore been possible. Among other advantages these lots permit a reduction in the amount of constituent assaying which must be done to provide a control having predetermined values.

Substantial difficulty has been encountered in placing this method into commercial use. The problem has centered on static build-up on the particles during such steps as sieving the production lots to eliminate particles outside a predetermined range, combining the production lots in a blender and metering the product portions into vials. The disadvantage of static charge accretion is that the final control or calibrator is rendered nonhomogeneous from vial to vial. This appears to be the result of retardation or outright removal of certain constituents during their passage through the various processing steps. For example, small particles are more likely to be removed from the product stream by static effects during blending because their light weight will result in adherence to the blender surfaces. On the other hand, static-aggregated large particles are more likely to be removed during seiving than aggregated small particles.

Further, it has been found that small serum particles, e.g. 12 mesh or smaller, exhibit depressed levels of creatine phosphokinase when compared to particles of larger size. Particle size may also differ among serum particles and additives such as drugs or additional serum constituents added to elevated normal levels. For example, these additives may be present as fine powders while the serum particles are in the form of small pellets. Additionally, these additives and different serum lots exhibit static behavior entirely independent of mass effects. For example, serum lots having different metal ion and protein levels can be expected to exhibit different static charges. The result is that the end of any given product stream will be enriched in, or possibly entirely devoid of some constituents. Thus it has been found that permitting serum particles to accumulate static charge results in considerable difficulty in securing vial to vial homogeneity.

Similar problems may be expected when processing other substances than sera. For example, blending drums for manufacture into homogeneous tablets or capsules, or blending plastic resins for manufacture into uniform articles, will be smilarly hampered by static charges acquired by the components being mixed.

Various techniques have been considered in an effort to prevent static charge accretion. For example, addition of an antistatic detergent to the product stream is precluded because such detergents may be deleterious to or affect the assay of serum constituents. Larger particles are less affected by static charge but they make precision weighing and filling of product vials extremely difficult. In the case of serum, obtaining particles having greater bulk density requires a burdensome concentration step. Further all of the foregoing options have not resulted in the desired control of static charge accretion.

Certain known electrical techniques for changing the static charge of particles, e.g. as shown in U.S. Pat. Nos. 2,896,263 and 3,864,602, require specialized apparatus in direct contact with the affected surface. This is impractical for use in such devices as blenders and in any case creates maintenance problems.

Accordingly it is an object of this invention to control, eliminate or prevent the formation of static charge on particles without adding a foreign substance to the particles or requiring a change in the desired size or composition of the particles.

It is a further object of this invention to control, eliminate or prevent the formation of static charge on dried, particulate animal body fluid.

It is another object to blend separate lots of dried, particulate animal body fluids whole maintaining the homogeneity of the blended product.

It is still another object to provide a method and apparatus for controlling, eliminating or preventing the formation of static charge in a region of a particle handling apparatus wherein such accumulation of charge normally occurs, but without requiring the presence of additional apparatus in that region.

Other objects of this invention will be apparent to those skilled in the art from a consideration of this specification taken in its entirety.

SUMMARY OF THE INVENTION

The above objectives are accomplished by treating dried, particulate animal body fluid in the usual fashion that would ordinarily give rise to static charge accretion, except that the particules are contacted with an ionized gas. In particular, the above objectives are accomplished by contacting particles, including particulate animal body fluid, with an ionized noble gas.

Conventional apparatus is provided having a treatment region. Ordinarily the particles would become statically charged during the use of such apparatus. However, this problem is obviated by modifying such apparatus to provide a source of gas communicating with the region and means for ionizing the gas. In particular, provided herein is an apparatus having a particle mixing chamber which is rotatable about a pair of trunnions, at least one of the trunnions having a passage for conducting gas into the chamber, the improvement comprising (a) a source of noble gas communicating with said passage, (b) means for ionizing the noble gas conducted through said passage and (c) means for electrically insulating said passage from said apparatus.

DESCRIPTION OF THE PREFERRED EMBODIMENTS

Figure 1:
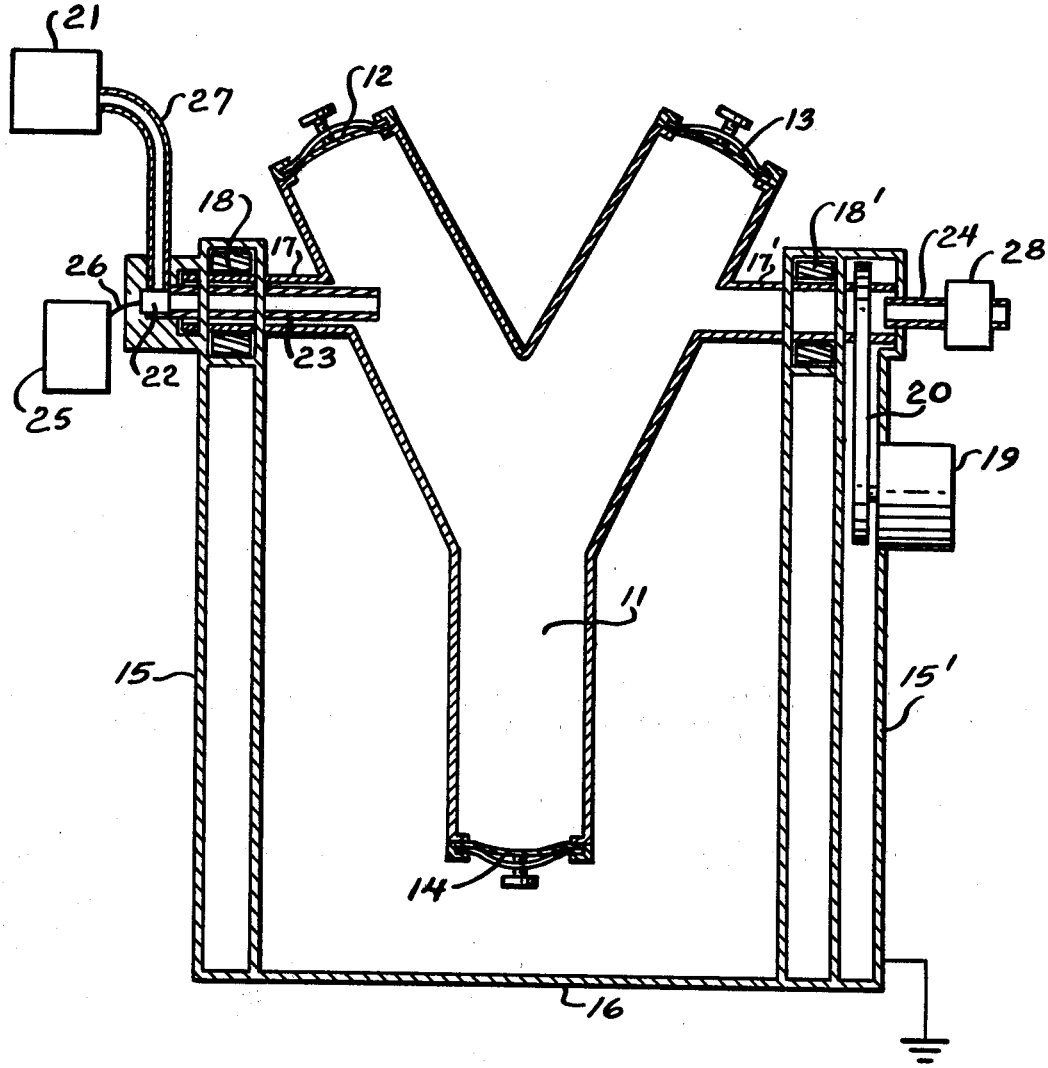
FIG. 1 is a cross-sectional view of a blender constructed in accordance with this invention.

Animal body fluids such as blood serum, spinal fluid, and blood plasma are extremely labile substances even in desiccated form; many constituents such as enzymes are easily susceptable to oxidation or denaturation and inactivation. Nonetheless, exposing such dried fluids to ionized gases left the levels of labile constituents unchanged.

It is preferred to employ a noble gas as the ionized gas, particularly for treating dried, particulate body fluids. Such gases are argon, neon, xenon, helium and krypton, in their approximate order of preference. Neon is particularly useful in preparing serum controls because its red emissions will not inactivate billirubin, but it is comparatively expensive. While satisfactory results may be obtained with other gases such as nitrogen, air or hydrogen, it is more difficult to separate the ionization means from the region one wishes to expose to the ionized gas; under the same conditions nitrogen or air may be ineffectual compared with argon, for example, and it is only by placing the ionizing device within or in close proximity to the treatment region of that beneficial results may be obtained with gases other than monoatomic noble gases. Mixtures of ionized gases, including gases other than noble gases, may be employed.

The gases are preferably ionized and then conducted to the treatment region. This is facilitated by the use of noble gases, particularly the monoatomic gases argon, neon, xenon and krypton. As described above, use of other gases will require that the ionization device be located in the treatment region or otherwise in close contact with the particles in question. This has been found to be especially beneficial where the contact of ionizing electrodes and powdered material would create an explosion hazard or deleteriously affect the material. Of course if these conditions are not considered controlling, e.g. the particles are of sufficient size and stability, one may employ an ionization device within the particle processing region.

Unlike some prior art devices such as those disclosed in U.S. Pat. Nos. 3,864,602, and 2,896,263, there is no need for an insulated conductor in contact with either the treatment region or the surface of an apparatus encompassed by that region. The ionizing gas is satisfactory by itself to control particle static charge. However, it is within the scope of this invention to supplement the use of ionized gas with particle modifications which aid in reducing the affect of static charge, e.g., increasing the bulk density or size of the dried animal body fluid particles.

Suitable particles which can be treated in accordance with this invention are organic and inorganic powders or pellets such as resins, clays, pigments and ores in addition to particulate animal body fluids. The greatest improvements are noted when the relative humidity of the atmosphere in contact with the particles is less than 10%, and in any case it is preferred that the relative humidity over dried blood serum or plasma be maintained at less than about 2% to ensure stability of labile components.

Dried human blood serum will ordinarily exhibit a net negative charge. However, particles having net positive charge, or a mixture of positive and negative charges, may be treated in accordance with this invention. Strangely, even though blood serum exhibits a net negative charge a negatively ionized gas has been found most effective in preventing charge accretion. However, positively charged gases will also yield satisfactory results. A mixture of positively and negatively charged ions are acceptable as well; it may be produced by using an alternating current with the gas ionizer in conventional fashion. This mixture is most effective when it is desired to remove previously statically charged particles which adhere to apparatus surfaces.

It is preferable to contact the ionized gas with the particles before they can begin to build up static charge. This is done by purging a particle treatment region with ionized gas, then supplying or generating the gas for so long as the particle treatment continues. The time at which the particles are contacted with ionized gas, the amount and charge of ionized gas provided, and the relative humidity can also be used to control rather than prevent or eliminate static charge build-up. For example, it may be desirable to permit a slight static charge to accumulate in a particle mixture so that very small particles will uniformly adhere to a large group of particles but without significant adhesion to the particle treating device surfaces. The optimum conditions to obtain such results may be readily determined by routine experimentation.

Any apparatus having a treatment region in which particles are agitated, either in contact with the apparatus or with one another, is improved by providing a source of ionized gas communicating with the treatment region. Such apparatus will be immediately apparent to the skilled artisan, for example, well-known screening devices such as disclosed in U.S. Pat. No. 3,864,602, powder weigh-and-fill equipment and blending machinery. The source of ionized gas should not be located within the treatment region itself, for the reasons discussed above. Rather, it should be placed into gaseous communication with the treatment region. This region will generally be co-extensive with the space in which the particulate material is in motion, and it is ordinarily enclosed within a dust-tight chamber. In the modified apparatus of this invention the chamber is pierced by ionized gas entry and exit ports which, in turn, are in communication with a means for ionizing the gas and a source of the gas. However, the device may simply contain an ionized gas exhaust nozzle directed at the treatment region. This is preferred where the region is open to the atmosphere as is commonly encountered in electrostatic ore separation devices and particle screening systems. The ionized gas loses its charge in the treatment region. However, the gas may be cycled back to the ionization means for re-ionization and the process repeated for as long as it is desirable.

If the ionized gas is routed through any grounded portion of the chamber or treatment device before entering the treatment region the gas must be electrically insulated from the ground. This is conveniently accomplished by conducting the gas through dielectric tubing such as tygon brand conduit before expelling it into the treatment region.

Suitable means for ionizing the gas are well known. Generally they fall into two clases, ionizing electrodes and radioisotope ionizers. It is preferred to use ionizing electrodes, although radiosotopic ionization devices such as sold by the 3M Corporation are desirable where electromagnetic discharges would interfere with sensitive electronic components. The electrode ionizer voltage setting and selection of positive or negative ions will depend upon the flow rate of ionizable gas, the nature of the particles and the amount of static charge expected to be encountered.

Suitable gas supplies are commercially available canisters of pressurized analytical grade gas. Argon is readily available in such form and is comparatively inexpensive. The purity of the gas will depend upon the susceptibility of the particles in question to any ionized impurities. The balance of optimum purity against cost will be a matter for routine experimentation. Also a matter for routine experimentation will be the flow rate of the gas; this will largely depend upon the physical characteristics of the treatment region, e.g. whether or not it is open to the atmosphere.

An exemplary device incorporating this invention is the blender shown in FIG. 1. A particle blending chamber 11 is provided with three access hatches 12, 13 and 14. The blending chamber 11 is supported upon base 16 by uprights 15 and 15', hollow trunnions 17' and 17 and bearings 18 and 18'. The chamber 11 is rotated about trunnions 17 and 17' by power unit 19 and power transfer system 20. The novel features of the blender include the hollow trunnions 17 and 17', gas supply 21 communicating via conduit 27 with ionizing electrode 22, dielectric tubing 23, gas exhaust conduit 24 and humidity sensing means 28 mounted in the gas path through exhaust conduit 24. Electrode 22 is supplied by transformer 25 by way of conductor 26. Trunnions 17 and 17' are free to rotate while electrode 22, its attached tubing 23 and conduit 24 remain in fixed position. In the use operation of this blender hatches 12, 13 and 14 are closed and a dry purging gas such as nitrogen is passed from gas supply 21 through conduits 27 and 23 and into chamber 11. This drying step is optional although preferred. It is ordinarily not useful to activate the ionization electrode at this time. Dessication of the blender interior may be accelerated by applying a vacuum to exhaust conduit 24. Once the relative humidity within chamber 11 is reduced below about 2% the gas supply is switched to a noble gas at a flow rate yielding about 4 psig within chamber 11, followed by application of appropriate voltage to ionization electrode 22 for the production of negatively or positively ionized gas. When the chamber 11 is filled with ionized gas the particles to be blended are placed in chamber 11, the power supply unit 19 is switched on and chamber 11 is rotated for a sufficient time to blend the serum lots. During this period the electrode 22 usually gives off a loud crackling. The ionized gas exiting dielectric tubing 23 glows in a color characteristic of the ionized gas, e.g. red with neon and yellow-white with argon. Following the completion of the blending, power unit 19 is stopped, electrode 22 is switched off and the supply of gas from source 21 is halted. The product may then be removed through one of the blender hatches 12, 13 or 14.

If hatches 12, 13 and 14 are not capable of a hermetic seal the cost of hollowing out trunnion 17' may be avoided since the gas entering chamber 11 can exhaust at hatches 12, 13 and 14.

The following specific examples are intended as illustrations but not limitations of the scope of the present invention.

EXAMPLE 1

A Patterson Kelley twin shell dry blender having a 7 cu. ft. capacity was modified as described above by drilling a passage through one trunnion. An assembly having a gas passage with and inlet and outlet as well as an orifice providing access to the passage was bolted to the blender support over the end of the hollow trunnion in sealing relationship therewith. A conventional ionization electrode was placed into the assembly orifice so that gas conducted through the assembly would flow over the probe. Tygon brand tubing was inserted into the ionized gas outlet so that the ionized gas passage would be fully insulated from the blender. The gas supply was connected to the assembly inlet. The relative humidity within the blender was reduced to 2% by alternate purging with dry nitrogen and vacuum. The argon supply was started while the ionizer was activated to supply negative charge at its maximum output of 18,000 volts. Then 1.56 lb each of two lots of lyophilized particulate bovine blood serum having 12 gm% protein and average sodium levels of 93 and 111 meg./l by triplicate determinations were placed into the modified blender. The rotation of the blender was commenced and continued for 5 minutes. The ionizer and blender were then switched off, the particulate serum was removed from the blender, random portions withdrawn and each portion carefully distributed into one of 26 25 ml-capacity vials. Each vial was reconstituted with water and duplicate sodium determinations conducted. The reconstitution variance was 0.00003513, the standard deviation 0.006049 and the coefficient of variation 0.156%. A statistical analysis of the assayed vials was made with correction for instrumental error but without any correction for the reconstitution error. The results showed a vial-to-vial variance of 0.0464, standard deviation of 0.2154 and a coefficient of variation of 0.21%.

EXAMPLE 2

Two other lots of serum having mean sodium levels of 130.5 and 151.2 meq./l were treated under similar conditions to Example 1 except that the blending was conducted in a closed blender. Under air no ionized gas was present and considerable adherence of serum particles to the blender wall was observed. The coefficient of variation for two groups of five vials using the same statistical treatment as in Example 1 was 0.55% and 0.43%.

Similarly, other experiments have shown that the vial-to-vial coefficient of variation to be expected without the use of ionized gas will range from 0.42% to as high as 0.73%. As can be readily seen the reproducibility of assay results based upon vial-to-vial homogeneity is greatly enhanced by the use of this invention.

I claim:

1. In a method for processing particles of dried animal body fluid during which said particles generate static charge, the improvement comprising contacting said particles with an ionized gas.

2. The method of claim 1 wherein the gas is a noble gas.

3. The method of claim 2 wherein the noble gas is argon.

4. The method of claim 1 wherein the particles are contacted with a continuous flow of said gas while processing said particles.

5. The method of claim 1 wherein the processing comprises blending separate lots of said particles.

6. The method of claim 5 wherein the body fluid is human blood serum.

7. The method of claim 6 wherein the particles are substantially spherical and range in size from about 12 to about 40 mesh.

8. The method of claim 1 wherein the ionized gas is contacted with said particles after the processing of said particles.

9. The method of claim 1 wherein the particles are contacted with said gas in the absence of simultaneous contact with an insulated electrical circuit.

10. The method of claim 1 wherein said gas is supplied at a pressure of about 4 psig.

11. The method of claim 1 wherein the particles are contacted with said gas in the presence of a grounded conductor.

12. The method of claim 1 wherein the ionized gas is a mixture of gases.

13. The method of claim 1 wherein the atmosphere surrounding said particles contains less than about 2% relative humidity before said particles are contacted with said ionized gas.

14. The method of claim 1 wherein the ionized gas is negatively charged.

15. The method of claim 1 wherein the ionized gas is positively charge.

16. The method of claim 1 wherein the ionized gas contains a mixture of positively and negatively charged ions.

17. The method of claim 1 wherein the particles are negatively charged.

18. In a method for processing particles during which said particles generate static charge, the improvement comprising contacting said particles with an ionized noble gas.

19. A method for blending separate lots of dried particulate human serum which comprises mixing at least two of said lots in the presence of an ionized noble gas.

20. The method of claim 19 wherein said lots exhibit a net negative charge and wherein said noble gas is negatively charged.

21. In an apparatus having a region wherein particles are agitated in contact with said apparatus or one another whereby said particles generate static charge, the improvement comprising providing a source of gas communicating with said region and a means for ionizing said gas.

22. The apparatus of claim 21 wherein the means for ionizing said gas is located apart from said region.

23. The apparatus of claim 22 including an electrically insulated conduit for passing said ionized gas through a grounded portion of said apparatus.

24. The apparatus of claim 21 including a means for measuring the relative humidity within said region.

25. The apparatus of claim 21 wherein the region in which said particles are agitated is the surface of a sieve.

26. The apparatus of claim 21 wherein the region in which said particles are agitated is the interior of a blending chamber.

27. The apparatus of claim 21 wherein the gas is a noble gas.

28. In a particle blending apparatus having a mixing chamber for said particles which is rotatable about a pair of trunnions, at least one of said trunnions having a passage for conducting a gas into said chamber, the improvement comprising (a) a source of noble gas communicating with said conduct, (b) means for ionizing the noble gas conducted through said passage and (c) means for electrically insulating said passage from said apparatus.

* * * * *